US012139875B2

(12) United States Patent
Seniauskas et al.

(10) Patent No.: US 12,139,875 B2
(45) Date of Patent: Nov. 12, 2024

(54) METHOD FOR ADJUSTING OR REPLACING A MANHOLE FLOATING TYPE HATCH

(71) Applicants: Kestutis Seniauskas, Kaunas (LT); Marius Medzius, Ordino (AD)

(72) Inventors: Kestutis Seniauskas, Kaunas (LT); Marius Medzius, Ordino (AD)

( * ) Notice: Subject to any disclaimer, the term of this patent is extended or adjusted under 35 U.S.C. 154(b) by 86 days.

(21) Appl. No.: 18/056,884

(22) Filed: Nov. 18, 2022

(65) Prior Publication Data

US 2023/0093545 A1 Mar. 23, 2023

(30) Foreign Application Priority Data

Sep. 20, 2021 (LT) ..... 2021 021

(51) Int. Cl.
*E02D 29/14* (2006.01)

(52) U.S. Cl.
CPC ..... *E02D 29/1445* (2013.01)

(58) Field of Classification Search
CPC ..... E02D 2300/00; E02D 29/1409; E02D 29/1445; E01C 23/06
See application file for complete search history.

(56) References Cited

FOREIGN PATENT DOCUMENTS

| | | | | |
|---|---|---|---|---|
| EP | 2128344 A1 | 12/2009 | | |
| WO | WO-99/29968 | 6/1999 | | |
| WO | WO-03050359 A1 * | 6/2003 | ..... | E01C 23/06 |

OTHER PUBLICATIONS

Fukiya I; WO-03050359-A1; Machine Translation (Year: 2003).*

* cited by examiner

*Primary Examiner* — Lee A Holly
(74) *Attorney, Agent, or Firm* — DLA Piper LLP (US)

(57) ABSTRACT

The present disclosure relates to the field of construction, and, more particularly, to the adjustment of the position of a floating manhole or the replacement of a manhole with a new manhole so that the manhole is aligned with the connecting surface, e.g., the roadway. The object of the disclosure is to make it quicker, easier, and cheaper to adjust the position of a floating manhole, or to replace the manhole with a new manhole by aligning the manhole surface with the connecting surface, e.g., the roadway.

6 Claims, 1 Drawing Sheet

METHOD FOR ADJUSTING OR REPLACING A MANHOLE FLOATING TYPE HATCH

CROSS REFERENCE TO RELATED APPLICATIONS

This application claims priority to Lithuanian Patent Application No. 2021 021 filed Sep. 20, 2021, which is incorporated by reference in its entirety.

TECHNICAL FIELD

This disclosure relates to the field of construction, specifically to the adjustment of the position of a floating type manhole or the replacement of a manhole with a new manhole so that the well manhole is aligned with the connecting surface, e.g. the roadway.

In most cases, wells are built under and are accessible through roads. Seasonal warming and/or freezing of the roadway surface and other causes create expansion and/or contraction of the surface surrounding the well. Often, the surface of the roadway around the well area is deformed, distorted, or loses integrity with the manhole. As a result, roadways need to be resurfaced from time to time. For all these reasons, the settling of the floating manhole damages vehicles, creates noise, or damages the concrete well itself, and its repair and adjustment of the well manhole with the newly formed roadway often requires a lot of time and financial costs.

There is a known method of raising the manhole to the desired position, in which a cylinder-shaped adjusting ring is placed on the upper part of the well, which is co-axial with the upper part of the well body. The upper part of the adjusting ring is then flush with the surface e.g., base layer asphalt concrete mixture. The manhole frame is placed on the adjusting ring so that its lower flange rests on it. Later, asphalt concrete mixture is poured around the adjusting ring and manhole (see W099/29968).

This method of raising the well manhole is quite expensive, as it consumes a large amount of newly laid asphalt concrete mixture, because when pulling the manhole, a large surface area of the asphalt concrete mixture is destroyed, a lot of new asphalt concrete mixture is relatively consumed, a large amount of waste is obtained, and it takes a lot of time to cut out the old asphalt concrete mixture.

There is a known method of renewing the surface around the manhole (see EP 2128344, 2011). This method involves raising the manhole to a first position, securing a compression ring or frame around the bottom flange of the manhole, lowering the manhole to a second position so that the compression ring or frame is in contact with the surface of the well casing casting materials, e.g., asphalt concrete mixture and injection into the cavity between the manhole and the well body and the lowering of the manhole into the third position.

This method of renewing the surface around the manhole of the well is expensive, very inconvenient to work on, takes a long time, where in the case of repairs on the roadway, it needs to be done quickly.

OVERVIEW

Aspects of the present disclosure provide a way to adjust the position of the floating manhole of the well faster, easier, cheaper, or to replace the manhole with a new one by aligning the surface of the manhole with the connecting surface, e.g., the roadway.

In an example embodiment, the manhole itself and the cracked, dented, deformed asphalt concrete mixture around it are heated with infrared rays to the required temperature, then a cylindrical protective sleeve of the appropriate diameter is inserted into the well cavity. Over the cracked, dented, and deformed asphalt concrete mixture around the well, the new asphalt concrete mixture is poured and mixed with the old covering and evenly distributed, then the protective sleeve is pulled out, the manhole is placed, and together with the asphalt concrete mixture distributed around it, compressed, forming a new homogeneous covering.

In addition, the infrared heating temperature depends on the type of asphalt concrete mixture, and the diameter of the protective sleeve corresponds to the diameter of the upper cavity of the well body and is made of a material capable of withstanding the force of the asphalt concrete mixture poured around it.

In an example embodiment, hot (laying temperature) asphalt concrete mixture is poured on the deformed asphalt concrete mixture surface around the well.

In an example embodiment, the manhole is newly placed and, together with the asphalt concrete mixture spread around it, compacted with the help of a vibratory roller or a vibratory plate.

Figure 1:
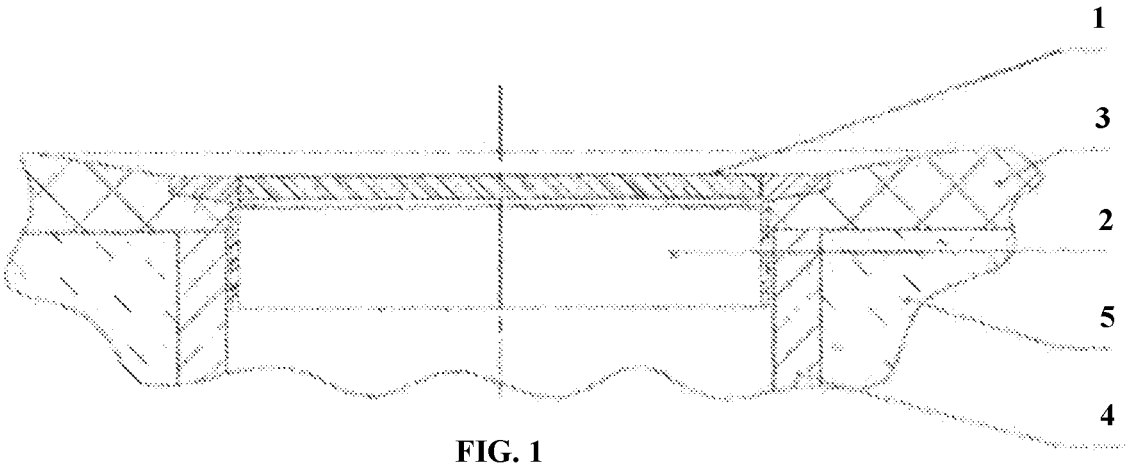
FIG. 1 shows well floating type manhole before adjustment or replacement.

The method of adjusting or replacing the floating type manhole is given in all the stages of the process in the above pictures, which shows the manhole cover 1, installed in the frame 2, asphalt concrete mixture 3, well 4, road base layer 5, newly laid asphalt concrete mixture layer 6, protective sleeve 7.

DESCRIPTION

In an example embodiment, before the manhole is raised, the manhole and the cracked, sunken, deformed asphalt surface around it 3, is heated to the required temperature by infrared rays, then a cylindrical protective sleeve 7 of the appropriate diameter is inserted into the cavity of manhole 4, the new asphalt concrete mix is poured onto the cracked, sunken and deformed asphalt cover 3 around the manhole 4, mixed with the old pavement and distributed evenly, then the protective sleeve 7 is removed, place the manhole cover frame 2, and, together with the asphalt concrete distributed around it, it is compacted to form a new homogeneous surface. The subsequent disclosure describes this process in more detail.

Figure 2:
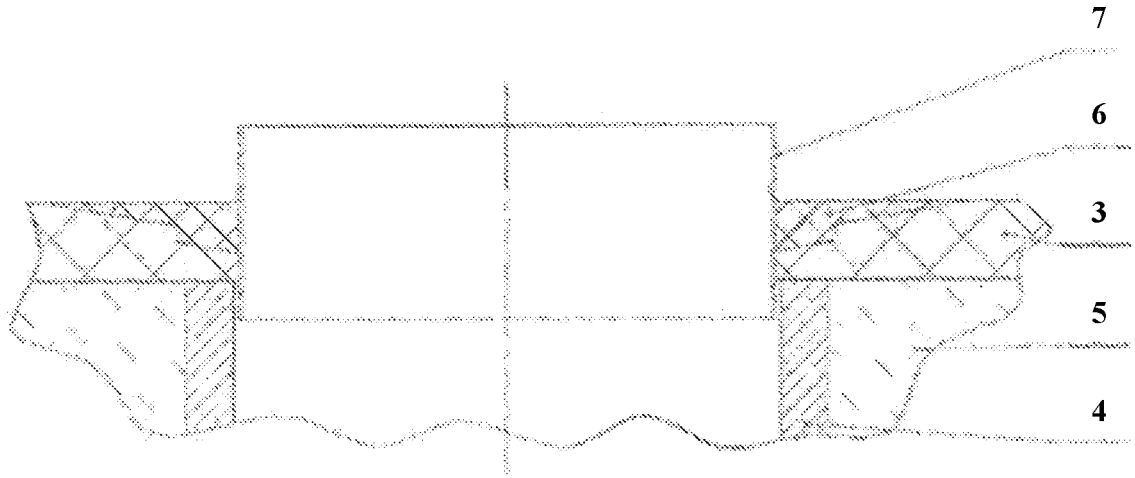
FIG. 2 shows a view of the well with the protective sleeve inserted during adjustment or replacement.
Figure 3:
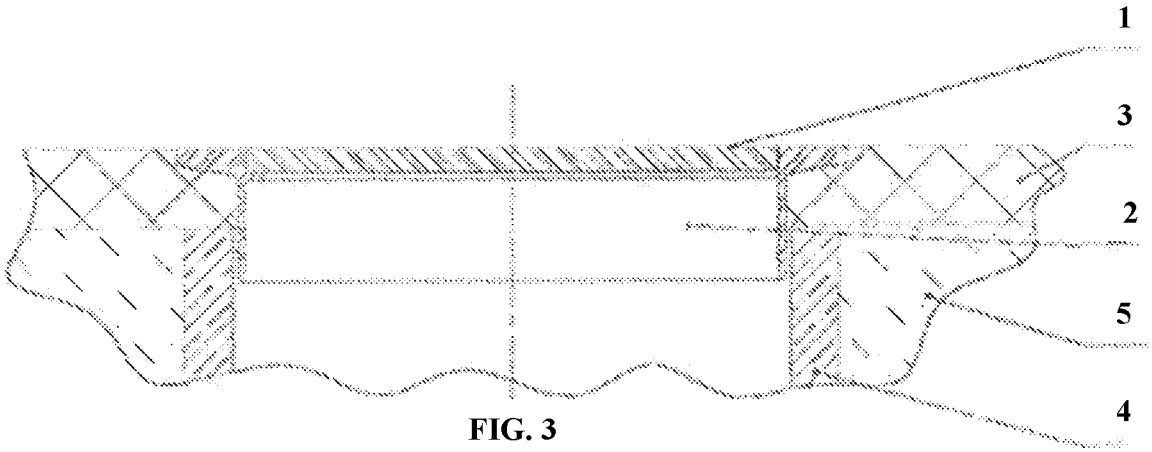
FIG. 3 shows a well floating type manhole after adjustment or replacement and compression with a vibratory roller or vibratory plate.

At the beginning, before removing the manhole frame 2 with the cover 1, the upper part of the manhole frame 2 and the cracked, dented, deformed asphalt concrete mixture 3 around it (FIG. 1) are heated by infrared rays to the required temperature, which already depends on the type of poured asphalt concrete mixture. The heated asphalt concrete mixture softens, which makes it easy to pull out the manhole frame 2. Next, a cylinder-shaped protective sleeve 7 of the appropriate diameter is inserted into the upper cavity of the well 4 (FIG. 2), which protects the well 4 during repair from asphalt concrete mixture and other debris entering its interior. The protective sleeve 7 is made of a material capable of withstanding the force of the asphalt concrete mixture mass poured around it. Hot (laying temperature) asphalt concrete mixture is poured onto the deformed asphalt concrete mixture 3 around the well 4, mixed with the old coating and evenly distributed. Since the deformed asphalt concrete mixture 3 is heated, and the asphalt concrete mixture poured on it is also hot (laying temperature), these two elements easily adhere to each other, forming a homogeneous mixture. Then, the protective sleeve 7 is pulled out, and the hatch frame 2 with cover 1 is placed in its place, which, together with the asphalt concrete mixture mass 6 distributed around it, is leveled with the roadway (FIG. 3) with the help of a vibratory roller or vibratory plate.

In an example embodiment, the infrared heating temperature depends on the type of asphalt cover, and the diameter of the protective sleeve 7 corresponds to the diameter of the upper cavity of the manhole 4 and is made of a material capable of withstanding the force of the mass of asphalt concrete poured around it, and hot (of laying temperature) asphalt concrete 6 is poured on the de-formed asphalt pavement 3 around manhole 4. The manhole cover frame 2 with lid 1 together with the asphalt concrete spread around it, is compressed by means of a vibratory rolling compactor or a vibratory plate compactor.

INDUSTRIAL APPLICABILITY

Compared with the prototype, in the floating manhole cover adjustment and/or replacement method, the deformed asphalt concrete mixture 3 around the manhole 4 and the upper part of the manhole frame 2 are heated by infrared rays, which facilitates the extraction of the manhole frame 2 from the manhole 4 without widely tearing the asphalt concrete mixture 3 around the manhole 4. All this allows quick, easy, inexpensive installation and adjustment of the manhole position with the connecting surface, e.g., the roadway. In addition, the protective sleeve 7 used during the process prevents asphalt concrete mixture and other debris from entering the well, preventing additional cleaning work.

The invention claimed is:

1. A method of adjusting and/or replacing a floating manhole, in which the manhole is lifted from the well, comprising before raising the manhole, the manhole and a surrounding cracked, concave, deformed asphalt concrete mixture surface are heated by infrared to a required temperature, then a cylindrical protective sleeve of diameter is inserted, a new asphalt concrete mixture is added over the cracked, concave, deformed asphalt concrete mixture around the manhole and mixed and distributed evenly, then pulls out the protective sleeve, installs the manhole and, together with the new asphalt concrete mixture distributed around it, compresses, a new homogeneous asphalt concrete mixture.

2. The method for adjusting and/or replacing a floating manhole according to claim 1, characterized in that the temperature of the infrared heating temperature depends on the type of asphalt concrete mixture.

3. The method for adjusting and/or replacing a floating manhole according to claim 1, characterized in that the diameter of the protective sleeve corresponds to the diameter of the upper cavity of the manhole frame.

4. The method for adjusting and/or replacing a floating manhole according to claim 1, characterized in that the protective sleeve is made of a material capable of withstanding the force of the mass of asphalt concrete mixture being poured around it.

5. The method for adjusting and/or replacing a floating manhole according to claim 1, characterized in that hot (laying temperature) asphalt concrete mixture is poured onto the asphalt concrete mixture deformed around the well.

6. The method for adjusting and/or replacing a floating manhole according to claim 1, characterized in that the manhole together with the asphalt concrete mixture distributed around it, is compressed by means of a vibratory roller or a vibratory plate.

* * * * *